US005078393A

United States Patent [19]

Morasiewicz

[11] Patent Number: 5,078,393

[45] Date of Patent: Jan. 7, 1992

[54] FOOT EXERCISING DEVICE

[76] Inventor: Kathleen G. Morasiewicz, 678 Burrows Avenue, Winnipeg, Manitoba, Canada, R2W 2A8

[21] Appl. No.: 385,876

[22] Filed: Jul. 28, 1989

[51] Int. Cl.[5] ..... A63B 23/04

[52] U.S. Cl. ..... 272/146; 272/111; 272/114

[58] Field of Search ..... 272/96, 97, 146, 93, 272/111, 114; 128/25 B

[56] References Cited

U.S. PATENT DOCUMENTS

| | | | |
|---|---|---|---|
| 2,726,845 | 12/1955 | Hyslop, Jr. et al. | 272/114 X |
| 2,964,315 | 12/1960 | Dinning | 272/97 |
| 3,361,427 | 1/1968 | Paves | 272/96 X |
| 3,416,792 | 2/1966 | Morgan | 272/146 |
| 3,598,404 | 8/1971 | Bowman | 272/572 |
| 4,505,477 | 3/1985 | Wilkinson | 272/146 |
| 4,601,469 | 7/1986 | Susser, Jr. | 272/111 X |
| 4,678,183 | 7/1987 | Skovajsa | 272/97 |
| 4,705,272 | 11/1987 | Rupprecht | 272/114 X |
| 4,759,542 | 7/1988 | Hudec | 272/111 |
| 4,787,630 | 11/1988 | Watson | 272/146 |
| 4,826,159 | 5/1989 | Hersey | 272/114 X |

FOREIGN PATENT DOCUMENTS

| | | | |
|---|---|---|---|
| 7901529 | 8/1980 | Netherlands | 272/146 |

*Primary Examiner*—Richard J. Apley
*Assistant Examiner*—Jerome Donnelly
*Attorney, Agent, or Firm*—Adrian D. Battison; Stanley G. Ade; Murray E. Thrift

[57] ABSTRACT

An exercising device comprises a simple flat board arrangement with a transverse rib across the underside defining a single pivot axis about which the board can pivot in a forward to rearward direction. The board is sized to receive the feet of the user and carries on the underside adjacent the rear edge a pair of resilient stop members and at the forward edge a carrying handle. A separate handle piece can stand up from the upper surface for manual assistance of the rocking action.

1 Claim, 2 Drawing Sheets

FOOT EXERCISING DEVICE

BACKGROUND OF THE INVENTION

This invention relates to a foot exercising device of a simple and economic construction which enables a user while seated and while carrying out other activities to gain effective and valuable exercise of the foot and lower body area.

Devices of this general type have been proposed previously and are shown for example in U.S. Pat. Nos. 3,967,820 (Harper); 1,509,793 (Thompson); 3,984,100 (Firster); 3,361,427 (Paves) and 1,497,243 (Martin). The above devices have achieved little success and have not widely been accepted. In some cases the device is too complex. In other cases the device provides a single point contact with the ground which renders it unstable and does not properly define or control the required movement of the user's feet.

SUMMARY OF THE INVENTION

It is one object of the present invention, therefore, to provide an improved device of a simple and economic nature which allows the user while seated to comfortably obtain a low impact exercising activity.

According to the first aspect of the invention there is provided a foot exercising device comprising an integral unitary body defining a substantially flat upper surface of longitudinal and transverse dimensions sufficient to receive and support the whole of the underside of both feet of a user, an under surface of the body including a straight transverse rib which can rest directly upon a ground surface and which provides a single straight pivot axis for the body transverse to the body and approximately at a mid point between front and rear edges of the body so that the upper surface can pivot relative to the ground about the single transverse pivot axis and is prevented from lateral pivotal movement.

According to the second aspect of the invention there is provided a foot exercising device comprising an integral unitary body defining a substantially flat upper surface of longitudinal and transverse dimensions sufficient to receive and support the whole of the underside of both feet of a user, an undersurface of the body including a transverse rib which can rest directly upon a ground surface and which provides a pivot axis for the body transverse to the body and approximately at a mid point between front and rear edges thereof so that the upper surface can pivot relative to the ground about the pivot axis, and a stop member mounted on the underside at a position spaced from the pivot axis and on the side of the rib adjacent the rear edge, the stop member being formed of a resilient material and extending downwardly from the underside to engage the ground surface to limit rearward pivotal movement.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
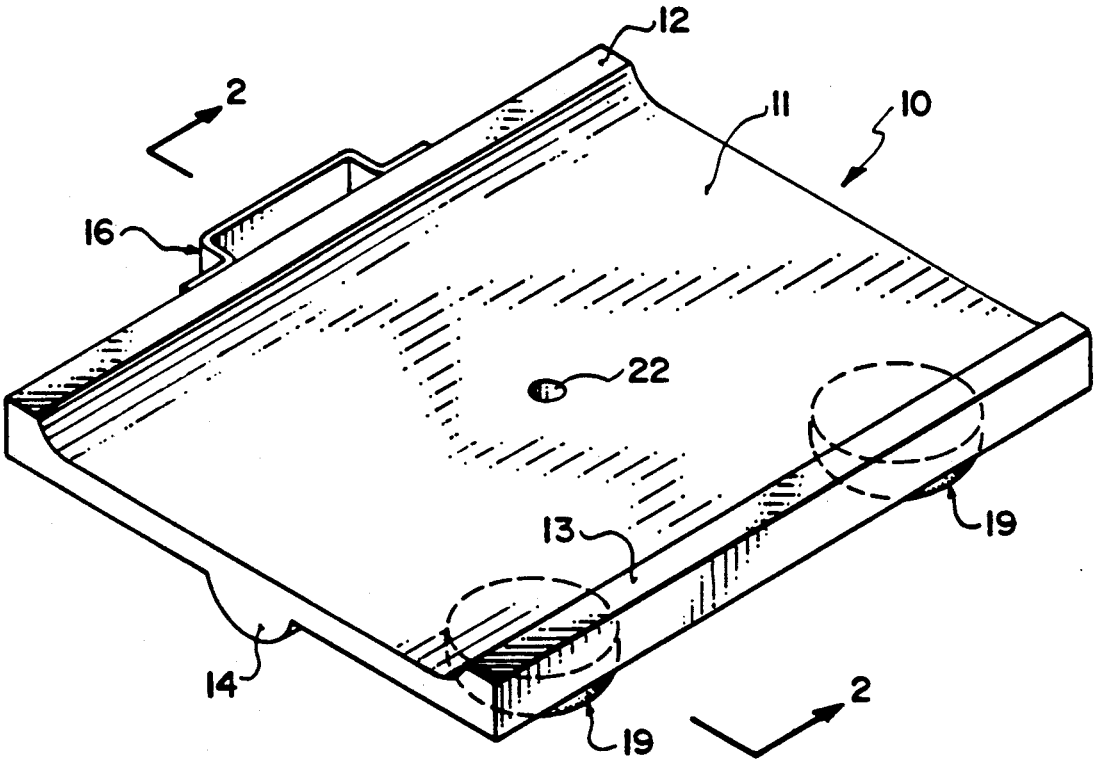
FIG. 1 is an isometric view of an exercising device according to the invention.

The device comprises a substantially flat board 10 the upper surface of which is recessed at 11 to define front and rear ribs respectively 12 and 13. The front to rear dimension of the board is sufficient so that it can receive the length of the feet of a user with the heels within the rear rib 13 and the toes rearwardly of the front rib 12. The side to side dimension of the device is sufficient so that it can receive the feet of the user in side by side position on the upper surface.

On the undersurface of the board 10 is an integral rib member 14 which extends across the full width of the board at a position midway between the front and rear edges so as to define a pivot axis 15 which is a straight line directly transverse to the board about which the device can pivot in a forward to rearward direction.

On the front edge of the device is mounted a handle 16 which projects outwardly from the front edge indicated at 17 so that the device can be grasped by the fingers of the user passing through the open portion of the handle and the board carried thereby suspended from the handle.

On the underside of the device adjacent the rear edge 13 is provided a pair of stop members 19. Each is formed from a hemispherical portion of a sponge rubber material which is thus of a resilient nature and is compressed partially onto the underside of the board by a screw 20 and washer 21 which pass symmetrically through the centre of the hemispherical body and hold it against the undersurface. Each of the stop members therefore acts to restrict the amount of pivotal movement in a rearward direction and to stop that pivotal movement in a gentle manner by a slight compression action on the stop member as the user tends to press down on the stop member at the rearward extent of the pivotal movement.

Figure 2:
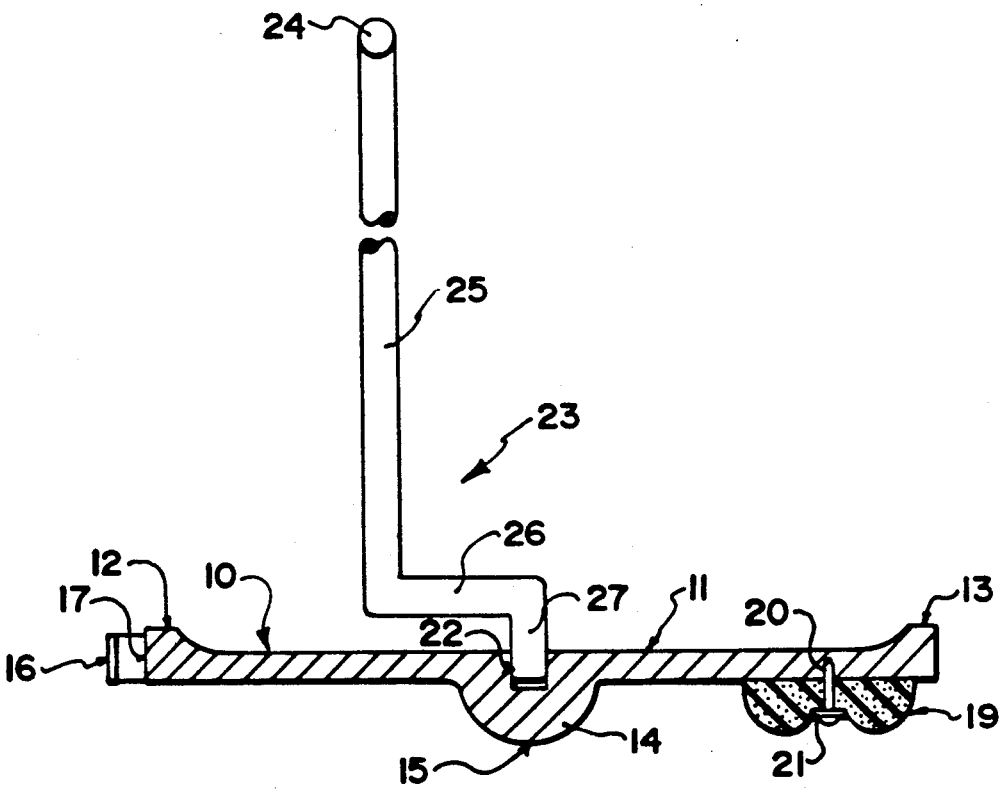
FIG. 2 is cross sectional view along the lines 2—2 of FIG. 1 with the addition of an extra handle piece.
Figure 3:
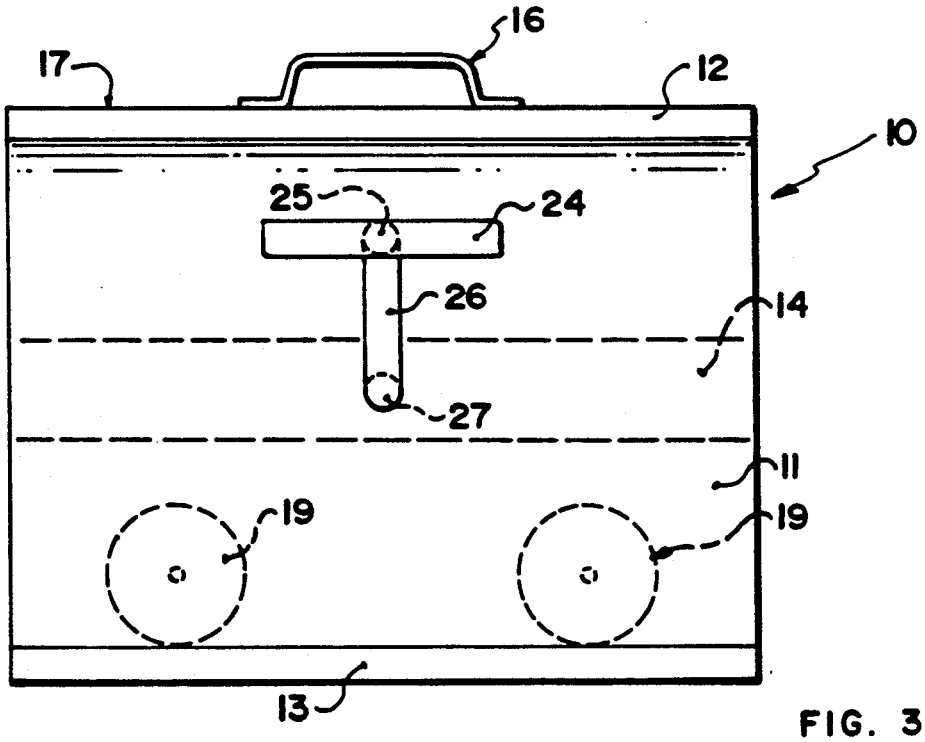
FIG. 3 is a top plan view of the device of FIG. 2.

Centrally of the upper surface is provided a blind hole 22 which as shown in FIGS. 2 and 3 can removably receive a handle piece 23. The handle piece comprises a cross-bar 24 which can be grasped by both hands of a user, particularly one of a handicapped or infirm nature. The cross-bar attaches to a vertical support strut 25, a horizontal extension piece 26 and a connection pin 27 which is a press fit in the hole 22.

In operation with the handle piece removed, the simple and inexpensive device is carried by the user to a position where it is intended for use and placed on the floor with the rear edge 13 adjacent the front of the feet of the user while in a seated position. The user then places the feet upon the upper surface within the recessed area so that the pivot axis 15 is transverse to the feet of the user and positioned approximately midway beneath the feet of the user. The user can then act to pivot the device back and forth in a gentle pivoting action with the stop members acting to restrict the rearward pivotal movement and to ensure that it is of a low impact nature. The device will only pivot about the single straight pivot axis 15 and will not pivot from side to side and hence provides a stable construction which generates the best exercising effect with little or no concentration by the user. The handle piece can be inserted for manual assistance of the rocking action by inform or handicapped patients.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A foot exercising device comprising an integral unitary body defining an upper surface of longitudinal and transverse dimensions sufficient to receive and support the whole of the underside of both feet of a user, the upper surface having a first transverse rib across the full extent of a front edge thereof, forwardly of the toes of the user and a second transverse rib across a full extent of a rear edge rearwardly of the heels of the user and being flat between said first and second ribs, an under surface of the body including a straight semicylindrical rod permanently fixed across the under surface so as to rest directly upon a ground surface to provide a single straight pivot axis for the body transverse to the body and approximately at a midpoint between front and rear edges of the body so that the upper surface can pivot relative to the ground about the single transverse pivot axis and is prevented from lateral pivotal movement, a pair of hemispherical stop members mounted on the underside of the body at a position spaced from the pivot axis and on the side of the rib adjacent the rear edge, the stop members extending downwardly from the underside to engage the ground surface to limit rearward pivotal movement of the upper surface and being formed of a resiliently compressible material such that force from the legs of the user while seated at the device can compress the material, the upper surface including a recess, a T-shaped handle piece having a leg at a lower end which is freely insertable into the recess to stand upwardly from the upper surface for manual assistance of the rocking action, the leg having a forwardly extending portion adjacent a lower end thereof such that a main portion of the leg is positioned forwardly of the recess and a carrying handle mounted on the front edge and extending forwardly therefrom.

* * * * *